US005964549A

United States Patent [19]

Frantzen

[11] Patent Number: 5,964,549

[45] Date of Patent: Oct. 12, 1999

[54] STRUCTURAL BEAM FOR CRACK REPAIR

[75] Inventor: Jeffrey A. Frantzen, Topeka, Kans.

[73] Assignee: Kansas Department of Transportation, Topeka, Kans.

[21] Appl. No.: 08/915,123

[22] Filed: Aug. 20, 1997

[51] Int. Cl.[6] ..... E01C 5/22

[52] U.S. Cl. ..... 404/44; 404/18

[58] Field of Search ..... 404/18, 47, 50, 404/51, 56, 64, 68, 66, 67, 44, 77, 31, 32, 33; 52/223.6, 223.7, 404.4, 414, 603, 796.12

[56] References Cited

U.S. PATENT DOCUMENTS

| | | | |
|---|---|---|---|
| 510,233 | 12/1893 | Bedgood . | |
| 529,772 | 11/1894 | Wilson . | |
| 898,001 | 9/1908 | Pellarin . | |
| 1,586,287 | 5/1926 | Calkins . | |
| 1,637,480 | 8/1927 | Gage . | |
| 2,127,709 | 8/1938 | Awbrey . | |
| 2,336,235 | 12/1943 | Fischer | 404/44 |
| 2,752,275 | 6/1956 | Raskin et al. | 404/44 |
| 2,951,001 | 8/1960 | Rubenstein | 404/44 |
| 3,557,671 | 1/1971 | Vasiloff . | |
| 3,915,582 | 10/1975 | Clarke . | |
| 3,932,051 | 1/1976 | Cleary . | |
| 4,015,302 | 4/1977 | Clark . | |
| 4,111,582 | 9/1978 | Tippett . | |
| 4,265,563 | 5/1981 | Marzocchi et al. . | |
| 4,533,278 | 8/1985 | Corsover et al. . | |
| 4,601,604 | 7/1986 | Clark et al. . | |
| 4,668,548 | 5/1987 | Lankard . | |
| 4,817,963 | 4/1989 | Munden et al. . | |
| 4,824,283 | 4/1989 | Belangie . | |
| 4,830,532 | 5/1989 | Macke et al. . | |
| 4,834,577 | 5/1989 | Perfetti . | |
| 4,856,930 | 8/1989 | Denning . | |
| 4,952,104 | 8/1990 | Osada . | |
| 5,185,013 | 2/1993 | Martin . | |
| 5,406,663 | 4/1995 | Chen . | |
| 5,513,925 | 5/1996 | Dempsey et al. . | |
| 5,603,134 | 2/1997 | Whipkey et al. . | |
| 5,653,551 | 8/1997 | Seaux | 404/44 |

*Primary Examiner*—Thomas B. Will
*Assistant Examiner*—Raymond W Addie
*Attorney, Agent, or Firm*—Chase & Yakimo, L.C.

[57] ABSTRACT

An apparatus for repairing a crack in a bituminous road surface utilizes a beam embedded in the road surface. A slot is cut in the road with the crack centered therein. A fiber reinforced plastic composite beam has a plurality of fingers extending from one end thereof. The beam is placed on a sand base in the slot with a straight end of the beam on one side of the crack and a serrated/finger end on the opposed side of the crack. A panel having apertures therein is positioned over the finger end of the crack. A course aggregate material is placed atop the sand base within epoxy material then filling the slot so as to anchor the beam therein. Upon curing, the road material is placed atop the beam and flush with the original road surface. The fingers are coated with a release agent to preclude binding with the surrounding epoxy material which allows for movement of the beam relative to the surrounding material upon forces acting upon the beam. The panel presents a zone for formation of subsequent cracking, such cracks easily being repaired with a sealing agent. The control of the cracking along this panel also provides for drainage away from the original crack.

21 Claims, 6 Drawing Sheets

STRUCTURAL BEAM FOR CRACK REPAIR

BACKGROUND OF THE INVENTION

This invention pertains to a method and apparatus for repairing cracks in pavements and, more particularly, to a method and apparatus for repairing transverse cracks in full depth bituminous and layered bituminous over concrete pavements.

Repairing cracks in road surfaces by applying an overlay to the road surface or by filling the crack with a variety of grout mixtures and other sealants is well known. In such methods, the road surface is prepared around the crack, the crack is filled with a sealing material to reduce the inflow of water and support wheel loads. The crack is bridged with a mesh material and covered with a bituminous overlay. One such method is shown in U.S. Pat. No. 5,185,013 to Martin.

A problem with past methods and materials is that the cracks always reappear in the surface overlay within a relatively short period of time due to thermal expansion and contraction of the pavement or cracking from the under surface. Various materials such as fabrics, wire meshes, and plastic grids have also been tried with mixed results.

Accordingly, it is desirable to provide a method and apparatus for repairing cracks in pavement that prevents reappearance of the cracks, controls future expansion cracks, and is a relatively long term repair.

SUMMARY OF THE INVENTION

It is therefore the primary object of the present invention to provide an improved method and apparatus for repairing cracks in bituminous pavement by bridging the deteriorated crack with a structural beam.

Another important object of this invention is to provide a method and apparatus, as aforesaid, which utilizes a structural beam with a notched or serrated end to provide a contraction joint spanning the original crack.

Another specific object of this invention is to provide such a method and apparatus, as aforesaid, to provide a controlled expansion cracking of the repaired surface which can be easily treated.

A still further object to the subject invention is to provide a method and apparatus, as aforesaid, which allow relative movement of the beam with the surrounding repair material in response to loads acting on the beam.

Yet another important object of this invention is to provide such a method and apparatus, as aforesaid, that is a relatively long term repair.

These and other objects of the invention are achieved by removing the pavement material around the crack, forming a slot in the pavement and bridging the crack with a structural beam placed in the slot. The structural beam having a straight edge and fingers projecting from an opposite edge, is secured in place with epoxy cement. The finger projections fit in a socket formed from the epoxy cement so as to present an expansion joint that allows for beam movement in response to thermal expansion and contraction of the surrounding pavement and loads acting thereon. The repair method minimizes roughness over the repaired area and eliminates reappearance of the deteriorated crack. A crack starter panel provides a controlled expansion crack in the repaired surface that can be treated with simple sealing.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
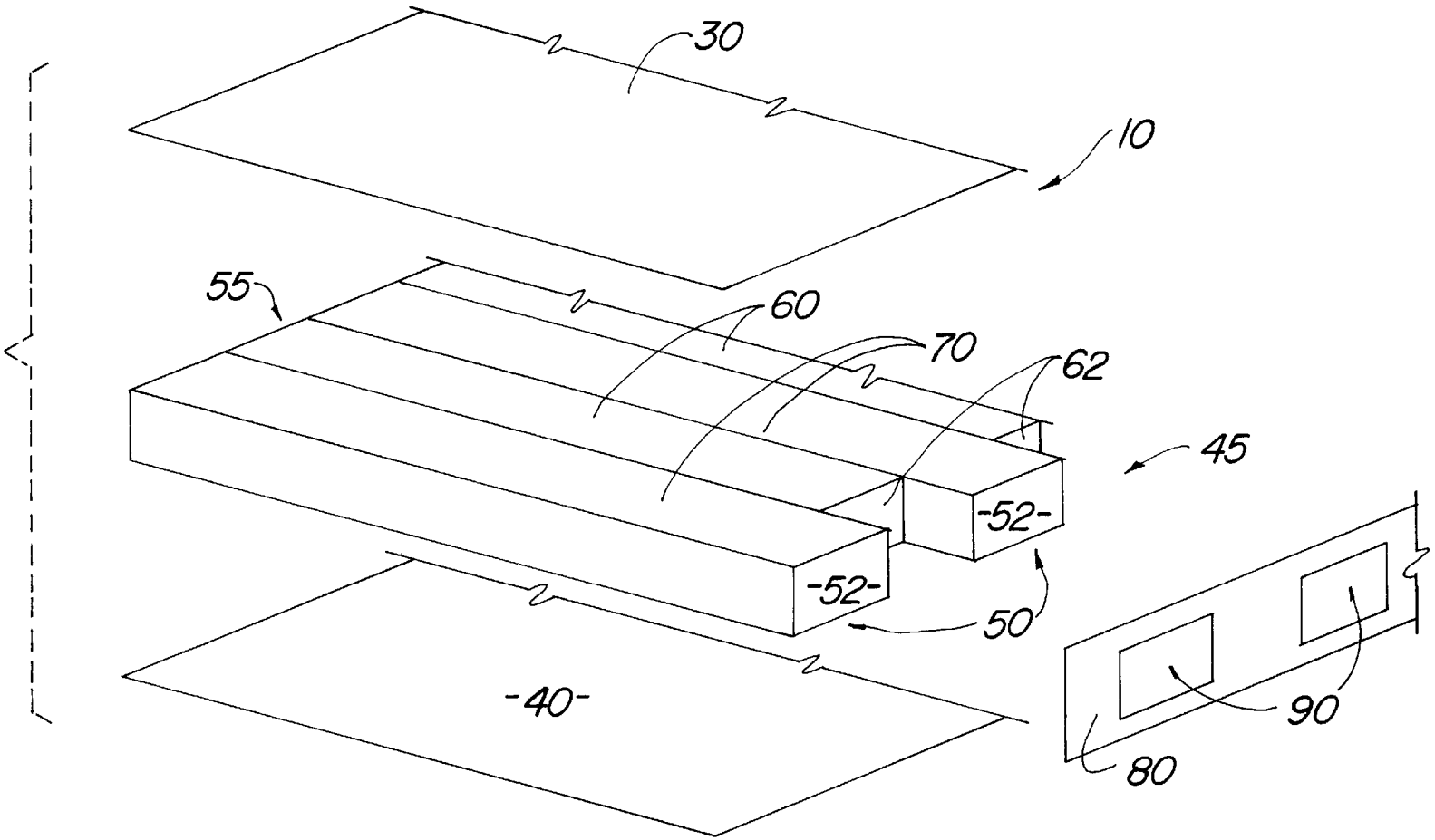
FIG. 1 is an exploded view of a portion of one embodiment of the structural beam utilizing box sections.

Turning more particularly to the drawings, FIG. 1 illustrates one embodiment of a structural beam 10 for repairing transverse cracks in bituminous pavements whether in a full depth bituminous pavement or a in partial depth bituminous pavement over concrete. The structural beam 10 is made up of approximately 24 box sections. The box sections are approximately six inches wide and three inches high. Two lengths of box section are used in the assembly, one box section 60 being approximately 30 inches long and the other longer box section 70 being approximately 34 inches long. These two box sections 60, 70 are alternately bonded together along adjacent side walls resulting in fingers 50 projecting from one end 45 of beam with the opposed end walls of the box sections 60, 70 being aligned at the opposed straight end 55 of beam. As such the end walls 52 of the fingers project beyond the end walls 62 of box sections 60 to present a serrated configuration. The box sections are filled with polyurethane foam to provide additional compression resistance to beam 10 and designed to support 9,000 pounds when loaded at the beam midpoint.

An upper skin 30 and lower skin 40 are bonded to the upper and lower surfaces respectively of the beam 10 to provide additional bending resistance to beam 10. The skins 30 and 40 are aligned with beam end 55 and are each approximately 12 feet long by 30 inches wide.

Figure 3:
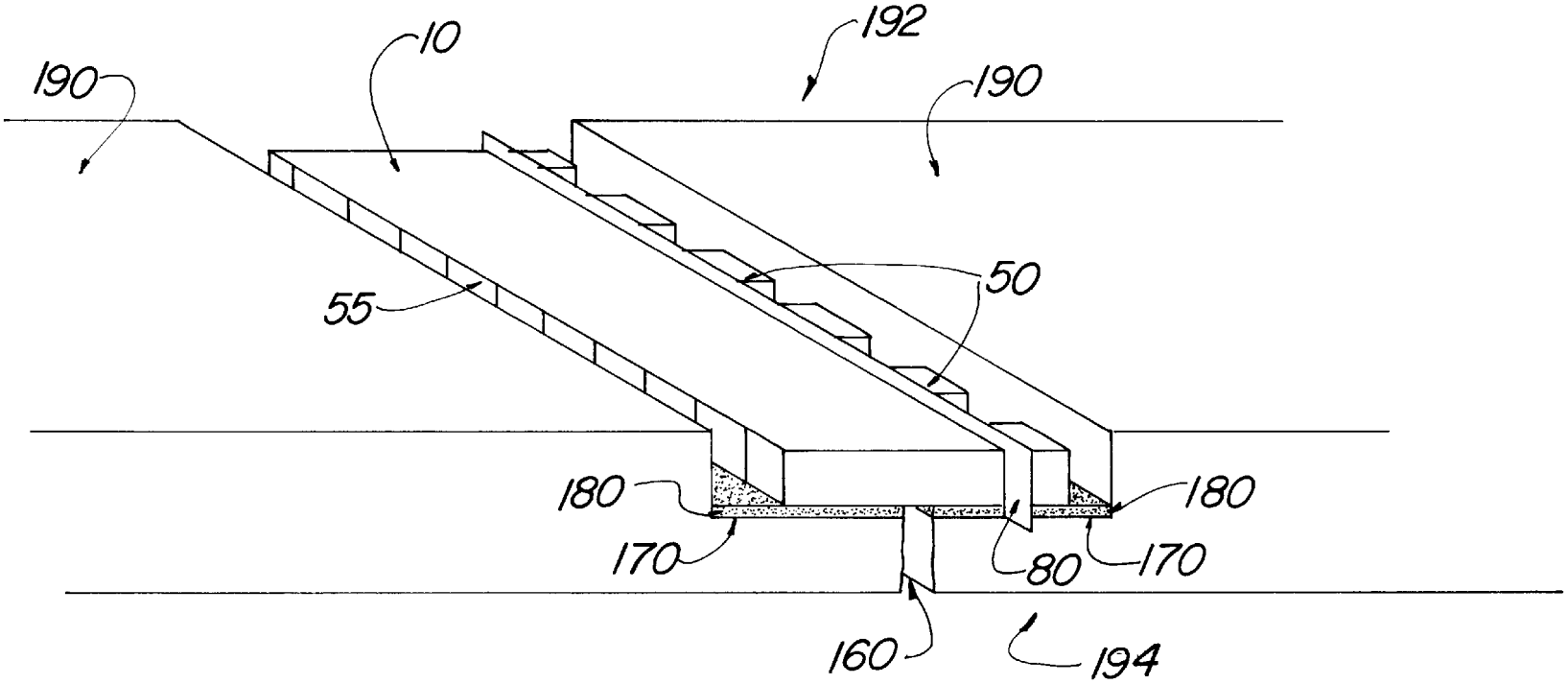
FIG. 3 is a perspective view of the repair area with the structural beam in a transverse slot including the deteriorated crack.

A crack starter panel 80 with rectangular apertures 90 engages end 45 such that the fingers 50 extend through apertures 90 and crack starter 80 is flush against the ends 62 of box sections 60 (FIG. 3). Apertures 90 are sized to easily slide over the fingers 50. Crack starter panel 80 is approximately 12 and one-half feet long and eight inches high.

The box sections 60, 70, skins 30, 40 and crack starter panel 80 are preferably fabricated from glass fiber/epoxy sheets, although other fibers such as kevlar or carbon and other matrices such as polyester can be used.

Figure 2:
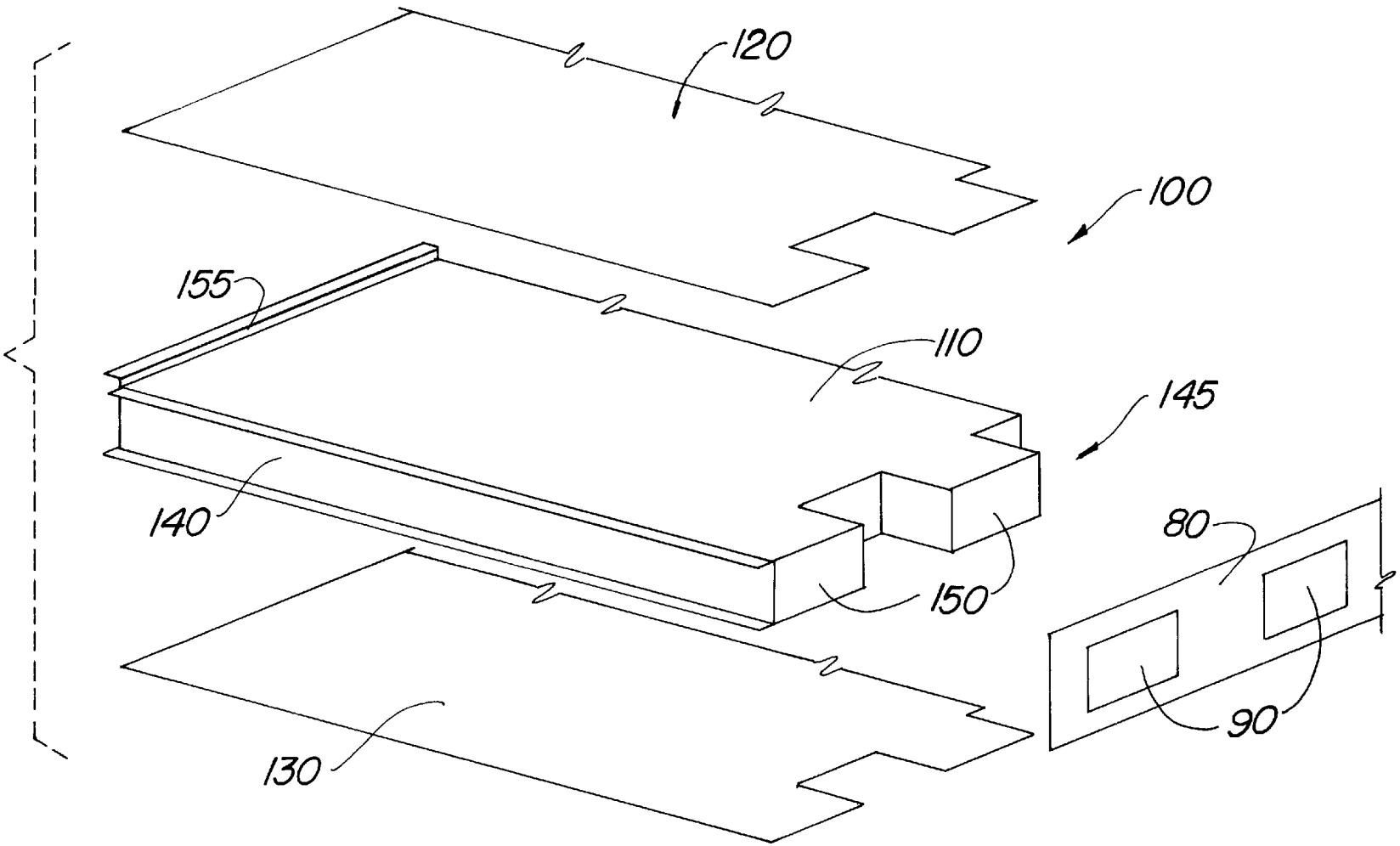
FIG. 2 is an exploded view of a portion of another embodiment of the structural beam utilizing a structural honeycomb core section.

Alternatively, as illustrated in FIG. 2, beam 100 consists of a unitary structural core 110 fabricated from aluminum or glass fiber honeycomb to provide shear and compression resistance to beam 100.

The structural core 110 is notched along end 145 so as to form finger projections 150. Edge supports 140 are bonded to the sides and straight end 155 of structural core 110 to prevent damage to the honeycomb and water intrusion. Upper skin 120 and lower skin 130 are bonded to the upper and lower surfaces of structural core 110 respectively. Edge supports 140 and skins 120, 130 are preferably fabricated from glass fiber/epoxy sheets, although other fibers such as kevlar or carbon and other matrices such as polyester can be used. The skins may be pre-shaped to match the upper surface configuration or may be notched after bonding to structural core 110.

Crack starter 80 panel engages the end 145 of beam 10 and cooperates therewith as with the above-described structural beam 10.

As illustrated in FIG. 3, upon formation of a crack 160 in a paved roadway 190, a lateral transversing slot is cut in the pavement 190, encompassing the deteriorated crack 160, to a depth of approximately five inches and a width of 36 inches (18 inches on each side of crack 160). Slot thus exposes a lower surface 170. As shown slot laterally transverses the opposed edges 192, 194 of a longitudinal extent of the roadway surface. Sand or other fine granular material 180 is evenly spread over the lowered slot surface 170 to cover any surface irregularities and to provide a uniform support pad for structural beam 10. Structural beam 10 with crack starter 80 engaged therewith is positioned in the slot and centered over crack 160 such that the beam 10 extends along the length of the slot. A release material such as grease, polymer or asphalt is then applied to all exposed surfaces of fingers 50 along end 45 to preclude a bonding of the fingers 50 to the adjacent road repair material.

Figure 4:
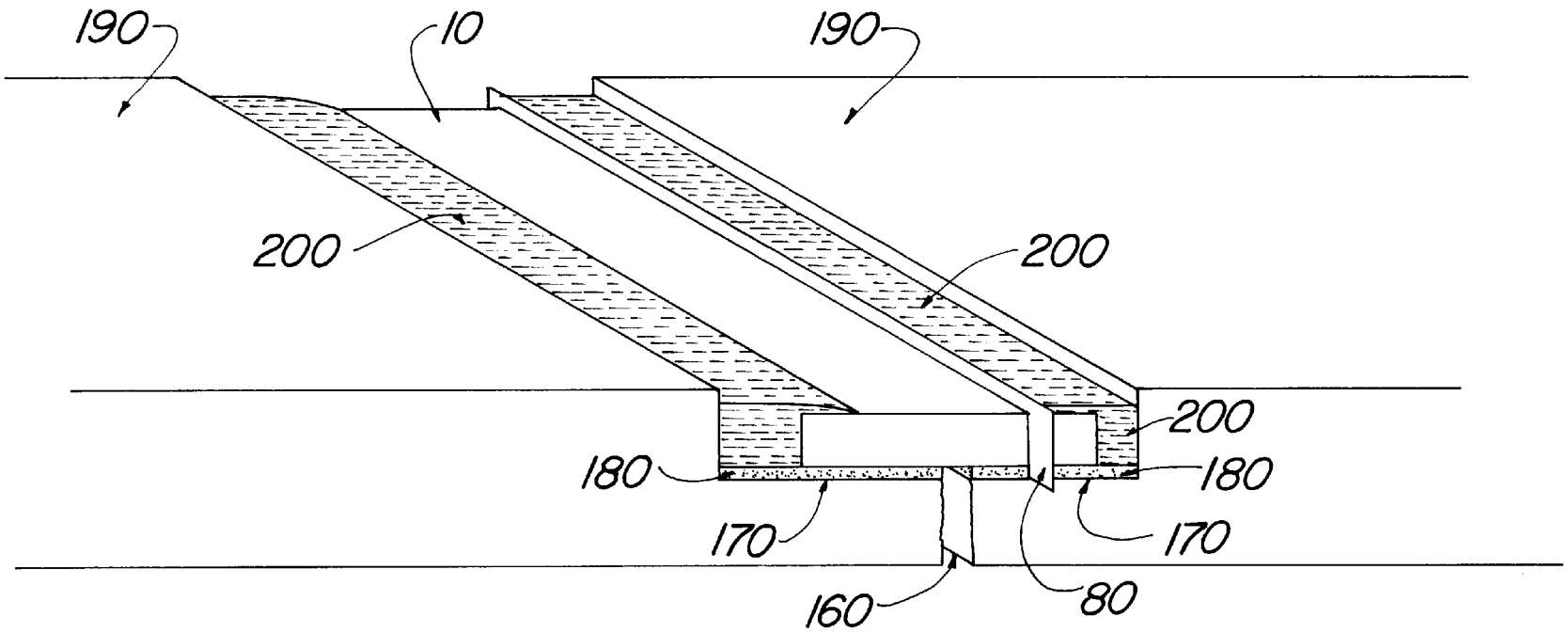
FIG. 4 is a perspective view of the repair area of FIG. 3 after application of the epoxy concrete.

Once beam 10 is centered over crack 160, a coarse aggregate (not shown) is placed atop the sand pad and about the beam 10 to fill the voids within the slot. As illustrated in FIG. 4, a construction grade quick-set epoxy cement or other suitable polymer 200 is poured in the slot to fill the slot and cover each end 45, 55 of beam 10 including the fingers 50. The epoxy cement 200 anchors beam 10 in place and forms sockets about fingers 50 at the beam end 45. The release material applied to the exposed surfaces of fingers 50 prevents bonding between the epoxy cement 200 and fingers 50. This action allows movement of beam 10 across crack 160 in response to thermal contraction and expansion of pavement 190 and in response to loads acting thereon. Thus, the fingers 50 present a contraction type joint embedded in the road 190.

Figure 5:
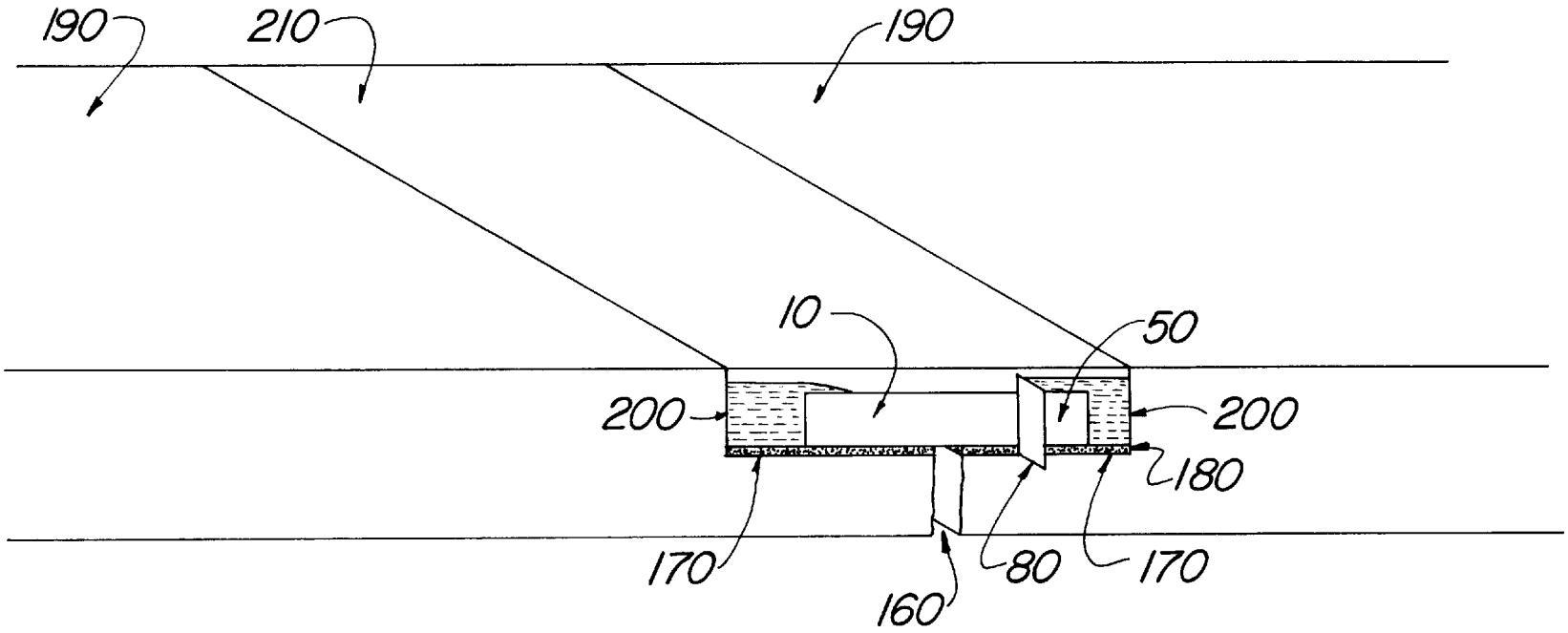
FIG. 5 is a perspective view of the repair area of FIG. 3 after application of the overlying road material.

As illustrated in FIG. 5, after the epoxy cement 200 sets, beam 10 is overlaid with approximately two inches of commercial grade asphalt hot mix 210 to bring the new repaired surface to a level flush with the original surrounding pavement 190.

The crack starter panel 80 will form a zone such that any subsequent thermal expansion cracks will be directed along the panel 80. Crack starter panel 80 thus controls the formation of expansion cracks therealong which can be easily maintained with simple sealing. Also the restriction of subsequently formed cracks to the zone of the panel 80 presents a drainage path displaced from the original crack. This path reduces inflow of water to the previously deteriorated crack 160 area.

It is also understood that beam 100, as above described, is used in a similar manner as beam 10 with the same accompanying advantages and results.

Figure 6:
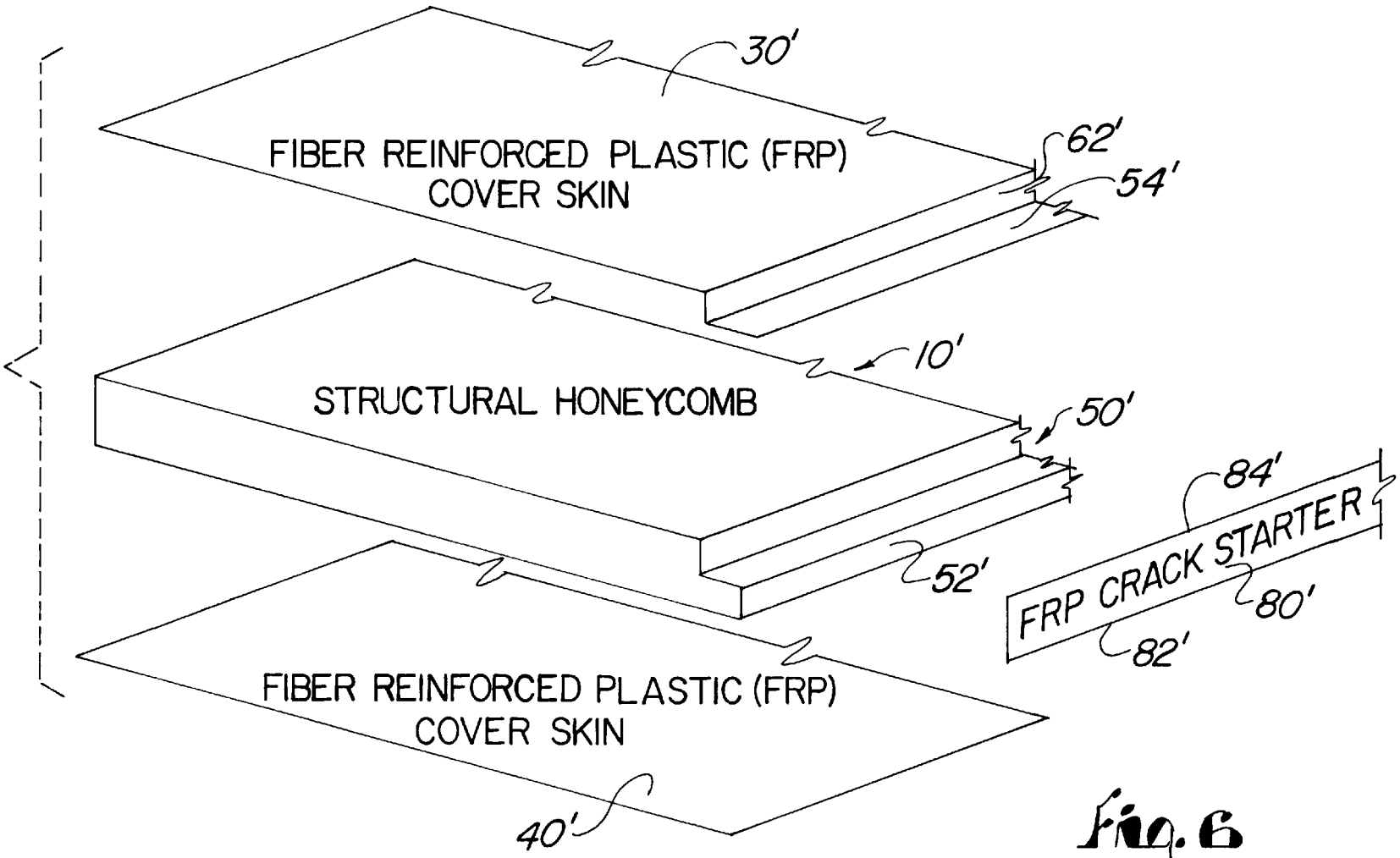
FIG. 6 is a perspective exploded view of an alternative embodiment of the invention.

An alternative embodiment is as shown in FIG. 6. Therein the beam 10' presents a shelf 50' in lieu of the fingers of beam 10. Shelf 50' spans the crack such that the end wall 52' is on one side of the crack 160 with the opposed beam end being on the opposed side of the crack. Skin 30' is placed atop beam 10'. Shelf 50' is coated with a release material to prevent bonding with the epoxy cement 200. Thus, movement of beam 10' across crack 160 in response to thermal contraction and/or expansion of the pavement in response to loads acting thereon is provided as in beam 10. Support for the sides of beam 10' may be provided by placing epoxy in the exposed cells in lieu of the edge supports 140.

A crack starter panel 80' is provided. Lower edge 82' rests on the shelf 50' with upper edge 84' extending above the top surface of beam 10' into the overlying concrete. The panel 80' is adhered to the inside vertical wall 62' of shelf 50'. The embodiment 10' is utilized in a manner as above described.

It is to be understood that while certain forms of this invention have been illustrated and described, it is not limited thereto except insofar as such limitations are included in the following claims and allowable functional equivalents thereof.

Having thus described the invention, what is new and desired to be secured by Letters Patent is as follows:

1. A beam for bridging a crack exposed in a slot cut in a road surface, the slot presenting an exposed surface about the crack in the road surface, said beam comprising:

a plurality of first and second sections of first and second lengths alternately bonded together to present a plurality of spaced apart fingers projecting from a first end of said beam;

said beam presenting top and bottom surfaces, said bottom surface adapted to be positioned atop the exposed surface of the slot with said first end of said beam adapted to be positioned on the exposed slot surface on one side of the crack and a second opposed end of said beam adapted to be positioned on the exposed slot surface on an opposed side of the crack;

a release material coated on said fingers, said beam adapted to be covered with a road material, said release material on said fingers providing for movement of said fingers in the surrounding road material upon forces acting on the road, wherein said beam presents a joint connecting said slot surfaces on opposed sides of the crack.

2. The beam as claimed in claim 1 further comprising:

a panel having apertures for receiving said fingers therethrough upon placement of said panel against said first end of said beam, said panel adapted to be positioned along the exposed surface of the slot for providing a zone for subsequent cracking of the road surface therealong.

3. The beam as claimed in claim 2 wherein said panel is a glass fiber/epoxy sheet.

4. The beam as claimed in claim 1 wherein said sections are foam filled.

5. The beam as claimed in claim 1 wherein said sections are formed from glass fiber/epoxy sheets.

6. The beam as claimed in claim 1 further comprising glass fiber/epoxy sheets of material on said top or bottom surfaces of said beam or both.

7. A reinforcing beam adapted for embedment in a road material for bridging an underlying crack therein, said beam comprising:

a body of compression resistant material presenting a top surface, a bottom surface and first and second opposed ends, said bottom surface at said body first end adapted to be positioned on a first side of the underlying crack with said bottom surface at said body second end adapted to be positioned on an opposed second side of the crack;

a plurality of spaced apart serrations projecting from said first end, said serrations presenting a surface adapted to contact the surrounding road material in relative movement therebetween upon forces acting on the body whereby to present a joint spanning the crack;

means at said first end of said body for forming an area for a controlled subsequent cracking of the road surface.

8. The beam as claimed in claim 7 wherein said forming means comprises:

a panel having a plurality of apertures therein for placement at said first body end with said serrations extending therethrough, said panel adapted to cooperate with the surrounding road material to present said area for subsequent cracking of the road surface therealong.

9. The beam as claimed in claim 7 wherein said body comprises a reinforced plastic honeycomb.

10. The beam as claimed in claim 7 wherein said body comprises aluminum honeycomb.

11. The beam as claimed in claim 7 further comprising a sheet of material positioned on said top or bottom surfaces of said body or both, said material sheet made of a material to resist bending of said body.

12. The beam as claimed in claim 7 further comprising a first support wall extending along said second end of said body.

13. The beam as claimed in claim 7 further comprising a coating on said serrations to preclude binding of said serrations with the surrounding road material, whereby to enhance said relative serration movement.

14. The beam as claimed in claim 7 wherein said body of compression resistant material comprises a plurality of first and second sections joined one to the other, said first and second sections configured to project a first end of said first section beyond a first end of an adjacent one of said second sections, said first end projections presenting said serrations.

15. The beam as claimed in claim 1 wherein said sections are box-like in configuration.

16. The beam as claimed in claim 1 wherein said sections are filled with a foam material of a type to resist compression on said beam.

17. The beam as claimed in claim 1 further comprising an upper skin surface bonded to said top surface, said skin surface of a material to resist bending of said beam.

18. The beam as claimed in claim 1 further comprising a lower skin surface bonded to said bottom surface, said skin surface of a material to resist bending of said beam.

19. A reinforcing beam adapted for embedment in a road of material for bridging an underlying crack therein, said beam comprising:

a body of compression resistant material presenting a top surface, a bottom surface and first and second opposed ends, said bottom surface at said body first end adapted to be positioned on a first side of the underlying crack with said bottom surface at said body second end adapted to be positioned on an opposed second side of the crack; and a shelf projecting from said body first end, said shelf presenting a projecting surface adapted to contact the surrounding road material in relative movement therebetween upon forces acting on the body whereby to present a joint spanning the crack.

20. The beam as claimed in claim 19 further comprising:

means at said first end of said body for forming an area for a controlled subsequent cracking of the road material.

21. A reinforcing beam for embedment in a road of material for bridging an underlying crack therein, said beam comprising:

a body of compression resistant material presenting first and second opposed ends, said body first end adapted to be positioned on a first side of the underlying crack with said body second end adapted to be positioned on an opposed second side of the crack;

a plurality of spaced apart serrations projecting from said first end, said serrations having a surface adapted to contact the surrounding road material in relative movement therebetween upon forces acting on the body whereby to present a joint spanning the crack.

* * * * *